US005096092A

United States Patent [19]

Devine

[11] Patent Number: 5,096,092

[45] Date of Patent: Mar. 17, 1992

[54] FOOD DISPENSING APPARATUS UTILIZING INFLATABLE BLADDER

[75] Inventor: Daniel J. Devine, New Berlin, Wis.

[73] Assignee: MMM, Ltd., Milwaukee, Wis.

[21] Appl. No.: 492,996

[22] Filed: Mar. 13, 1990

[51] Int. Cl.[5] ..... B65D 35/00

[52] U.S. Cl. ..... 222/95; 222/105; 222/146.5; 222/183; 222/325; 222/386.5

[58] Field of Search ..... 222/95, 105, 146.5, 222/183, 325, 386.5, 146.2; 219/436, 438, 441, 442, 535, 548, 549

[56] References Cited

U.S. PATENT DOCUMENTS

| | | | |
|---|---|---|---|
| 3,173,579 | 3/1965 | Curie et al. | 222/105 |
| 3,294,289 | 12/1966 | Bayne et al. | 222/386.5 X |
| 3,325,058 | 6/1967 | West, Jr. | 222/146.5 |
| 3,445,039 | 5/1969 | Brodsky et al. | 222/183 X |
| 3,973,102 | 8/1976 | Macklem | 219/442 X |
| 4,133,456 | 1/1979 | Corini | 222/146.5 |
| 4,147,278 | 4/1979 | Uhlig | 222/95 X |
| 4,264,019 | 4/1981 | Roberts et al. | 222/95 |
| 4,450,987 | 5/1984 | Boettcher et al. | 222/105 X |
| 4,539,005 | 9/1985 | Greenblatt | 222/95 X |
| 4,614,859 | 9/1986 | Beckering et al. | 222/146.5 X |
| 4,616,125 | 10/1986 | Oppitz | 219/548 X |
| 4,757,920 | 7/1988 | Harootian, Jr. et al. | 222/183 X |
| 4,796,788 | 1/1989 | Bond | 222/95 X |
| 4,833,305 | 5/1989 | Mashimo et al. | 219/549 |
| 4,901,886 | 2/1990 | Kirschner | 222/95 X |
| 4,921,135 | 5/1990 | Pleet | 222/95 X |

FOREIGN PATENT DOCUMENTS

| | | | |
|---|---|---|---|
| 254544 | 9/1964 | Australia | 222/95 |
| 0276994 | 8/1988 | European Pat. Off. | 222/95 |
| 2540850 | 8/1984 | France | 222/105 |
| 2172663 | 9/1986 | United Kingdom | 222/105 |
| 2188305 | 9/1987 | United Kingdom | 222/105 |

*Primary Examiner*—Michael S. Huppert
*Assistant Examiner*—Anthoula Pomrening
*Attorney, Agent, or Firm*—Robert S. Beiser

[57] ABSTRACT

A food dispensing apparatus is provided having an aluminum housing with an opening at its top surface, a cover for the opening, an outer enclosure disposed about the housing, a bag of food product disposed within the housing, a manually operated valve attached to a first end of the food bag and in fluid communication therewith for dispensing the food product, a bladder connected to a source of pressurized air and disposed within the housing for compressing the bag of food product for selective dispensing from the apparatus and a heating mechanism contained within the housing for inductively heating the food product for use.

38 Claims, 6 Drawing Sheets

FOOD DISPENSING APPARATUS UTILIZING INFLATABLE BLADDER

BACKGROUND OF THE INVENTION

1. Field of the Invention

The present invention relates generally to food dispensing devices and more particularly to an apparatus for dispensing viscous food products, such as ice cream toppings, hot fudge, nacho cheese, and other paste like products.

2. Prior Art

Bag-in-box packages have been in use for a number of years in packaging various products. An example is U.S. Pat. No. 3,173,579. These packages are used mainly for holding and dispensing liquids which will readily flow by gravity from the bag when the dispensing valve thereof is opened. However, they are not ordinarily used for containing and dispensing viscous and semi-viscous substances because of the requirement of dispensing mechanisms, such as pumps.

One solution to this problem has been the development of a bag having two chambers, as shown in U.S. Pat. No. 4,796,788. The first chamber is used to contain the food product and the second chamber is used, when supplied with compressed air, to compress the food product container for dispensing such products as salad dressings, ketchup, mustard, pizza sauce, etc. However, a problem with the system disclosed in the '788 patent is that a special, relatively expensive bag was manufactured, and the elasticity of the pressurized chamber is limited because of the physical requirements of the bag needed to contain the food products. In addition, no means are described for heating the food products contained in the bag.

U.S. Pat. No. 3,325,058 discloses an electrically heated receptacle and disposable containers therefore. A substantially rigid plastic tank is provided having a spigot at its lower end. The tank has a sloping bottom surface. An outer housing is provided for receiving the tank which has a heating element contained therein. As a result, when the tank is contained within the outer housing the food product contained within the tank may be heated and dispensed by a gravity feed. No means are provided for pressurizing the tank.

U.S. Pat. No. 3,837,533 discloses a container made of a light weight flexible sheet having a downwardly sloped portion in conformity with a slopped portion of a housing. The container has a nozzle used to dispense ketchup, mustard and mayonnaise. U.S. Pat. Nos. 2,766,907; 3,417,901; 3,508,686; and 3,941,258 each generally show multiple bladders.

U.S. Pat. Nos. 2,766,907; 3,494,513; 3,508,686; 3,941,258; and 4,120,425 each generally show pressure sources for dispensing products. U.S. Pat. No. 4,094,446 shows heating and dispensing of a food product using an electric pump.

Although each of the above listed patents discloses means for dispensing fluid products, the above listed prior art does not teach an inexpensive method of dispensing such fluid products nor a method of selectively heating such products when contained within a bag.

SUMMARY OF THE INVENTION

Accordingly, it is an object of the present invention to provide a low-cost means of dispensing viscous and semi-viscous food products.

It is an additional object of the present invention to provide an apparatus for heating viscous food products for easy dispersal to the public.

It is a further object of the present invention to provide such a food dispensing apparatus which is low in cost, easy to manufacture and easy to repair.

In accordance with the aforesaid objects, a food dispensing apparatus is provided comprising an aluminum housing having an opening proximate its top surface; a cover for said opening; an outer enclosure disposed about the housing; a bag containing a food product disposed within the housing; a manually operable valve attached to a first end of the bag and in fluid communication therewith, the valve being selectively operable to dispense food product from the bag; a bladder connectable to a source of pressurized air disposed within the housing and abutting the food bag so that inflation of the bladder compresses the food bag thereby permitting selective dispensing of the food product from the food bag; and a heating mechanism attached to the aluminum housing for heating the housing, thereby inductively heating the food product in the food bag. The heating mechanism preferably comprises an electric heating pad, a thermostat, an on/off switch and an indicator light. The food bag is preferably constructed of polyethylene having a polypropylene valve. The bladder is constructed of rubber or neoprene and is constructed and arranged so as to form across the entire surface of the food bag thereby uniformly compressing the product contained therein for easy dispersal. The aluminum housing is shaped so as to maximize the flow of the food product. Specifically, the front surface of the housing is sloped inwardly so as to cause the food product bag to be progressively reduced in size as the product contained therein is dispensed. At the same time, the area of contact between the bladder and the food product bag is maximized so as to retain the maximum amount of pressure on the food product bag.

DETAILED DESCRIPTION OF THE PREFERRED EMBODIMENT

Figure 1:
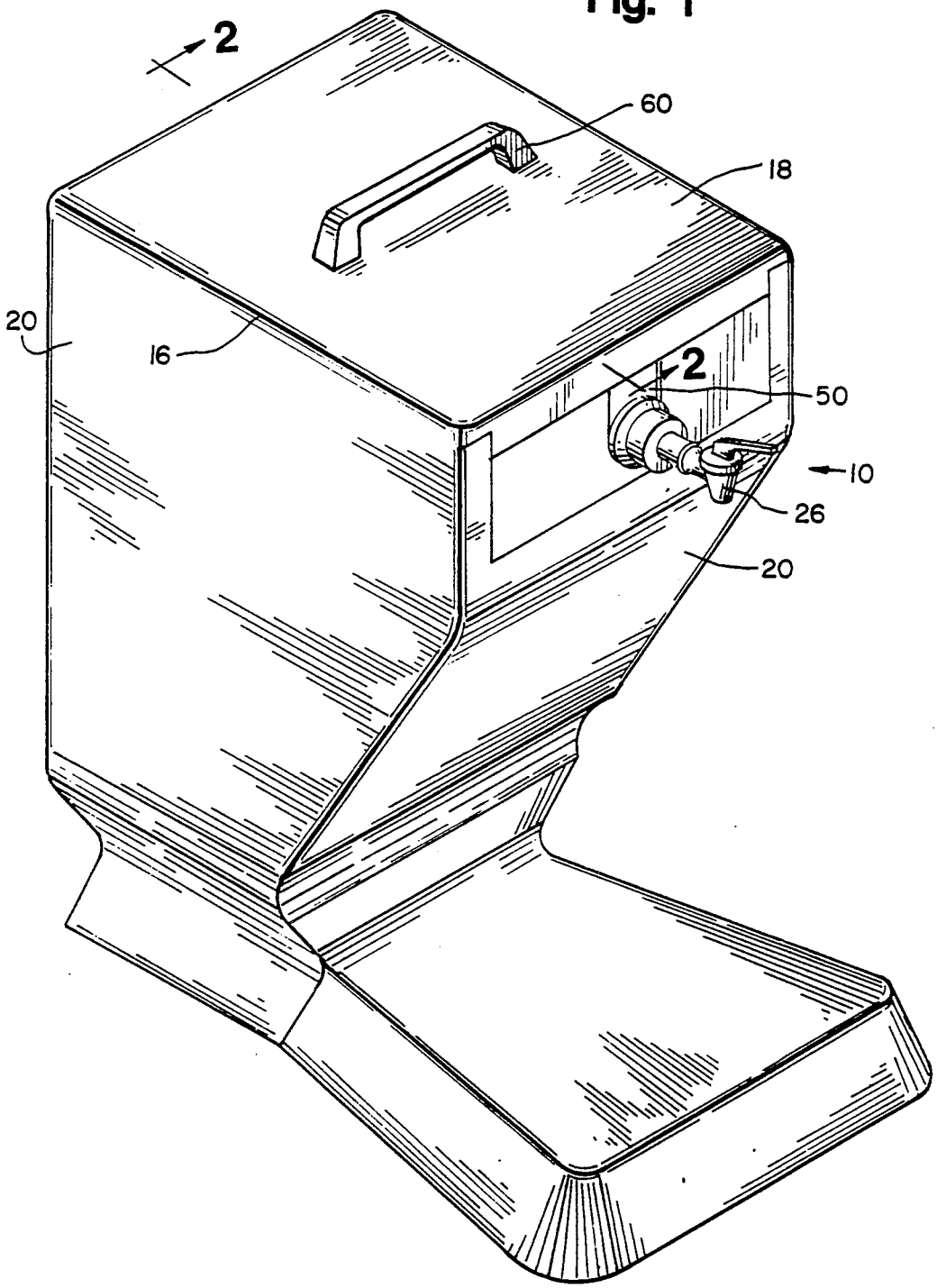
FIG. 1 is a front perspective view of the food dispensing apparatus of the present invention.

While the invention is susceptible of embodiment in many different forms, there is shown in the drawings and will herein be described in detail, several specific embodiments with the understanding that the disclosure contained therein is not limited to the specific embodiments disclosed but should be interpreted in light of the claims.

Figure 2:
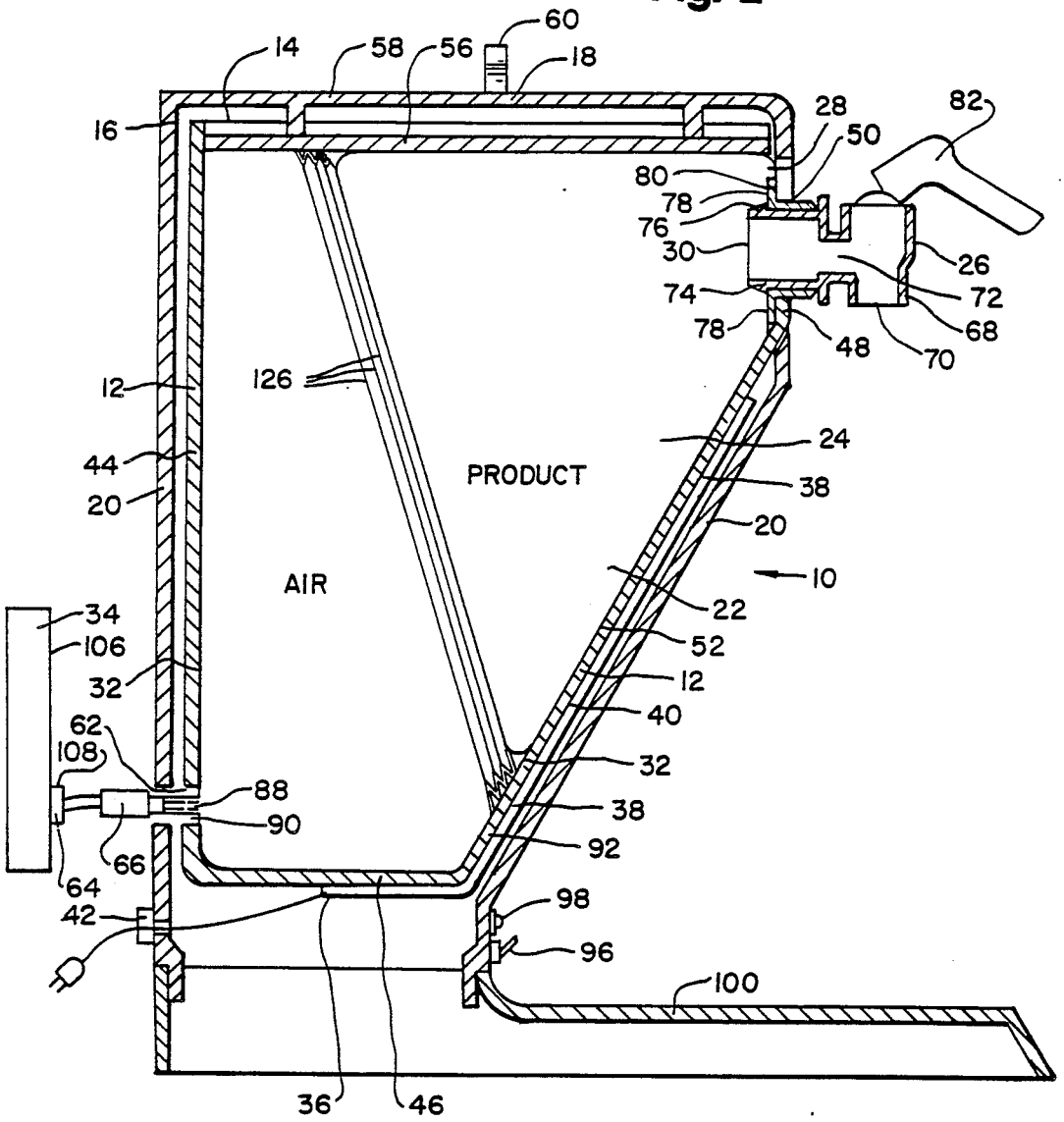
FIG. 2 of the drawings is a vertical section taken along line A—A of the food dispensing apparatus of FIG. 1.

As best shown in FIGS. 1 and 2 of the drawings, a food dispensing apparatus 10 is disclosed having an aluminum housing 12 having an opening 14 proximate its top surface 16. A cover 18 is provide for closure of the opening 14. An outer enclosure 20 is disposed about the aluminum housing 12. A bag 22 containing a food product 24, such as hot fudge is disposed within the aluminum housing 12. A manually operable valve 26 is attached at a first end 28 of the food bag 22, and is in fluid communication therewith through a lumen 30. The manually operable valve 26 is selectively operable to dispense food product 24 from the food bag 22, as desired. A bladder 32, preferably constructed of rubber, is connected to a source of pressurized air 34 and is disposed within the aluminum housing 12. The bladder 32 abuts against the food bag 22 so that inflation of the bladder 32 causes compression of the food bag 22, thereby permitting selective dispensing of the food product 24 from the food bag 22 when the valve 26 is opened. A heating mechanism 36 is attached to the aluminum housing 12 for heating the aluminum housing 12, and thereby, inductively heating the food product 24 contained within the food bag 22.

In a preferred embodiment, the heating mechanism 36 comprises an electric heating pad 38 fixedly attached to a first surface 40 of the aluminum housing 12. In a preferred embodiment, the heating pad 38 requires a current of 110 volts, has an electrical resistance of 350 watts and heats the aluminum housing 12 to a temperature of between 120° and 140° F. This is accomplished, in a preferred embodiment by an Ogden 5" by 8" heating pad, having a thickness of 0.020". A thermostat 42 may be electrically connected to heating pad 38 or may be integrally formed therein for controlling the temperature of the heating mechanism 36 and, thereby the temperature of aluminum housing 12. Further, heating mechanism 36 includes a switch mechanism 96 for selectively actuating the heating mechanism 36 and visual indicia, such as a light 98 for indicating the on condition of the heating mechanism 36. Further, insulation means may be provided for preventing overheating of food bag 22. Heating pad 38 is preferably constructed of elastomer, or a thermoplastic elastomer blend. Similarly, aluminum housing 12 preferably comprises 3/16" thick aluminum of 319 grade. However, other grades and thicknesses of aluminum may be utilized. In addition, although aluminum housing 12 is described as aluminum, it is possible to manufacture housing 12 of other metals or even of other thermoplastic materials which have lesser degrees of heat inductance but are adequate for purposes of the disclosed invention. An air gap 54 between the enclosure 20 and the aluminum housing 12 allows even distribution of heat and further prevents the enclosure 20 and the plastic shield portion 58 of cover 18 from becoming excessively hot to the touch.

Figure 3:
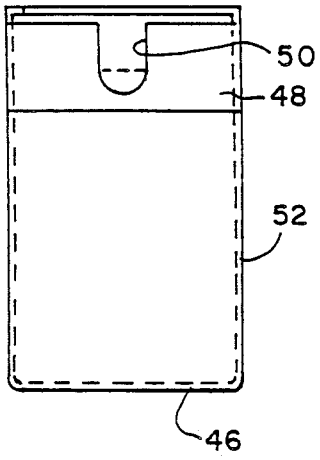
FIG. 3 of the drawings is a front elevational view of the aluminum housing of the food dispensing apparatus of FIGS. 1 and 2.
Figure 4:
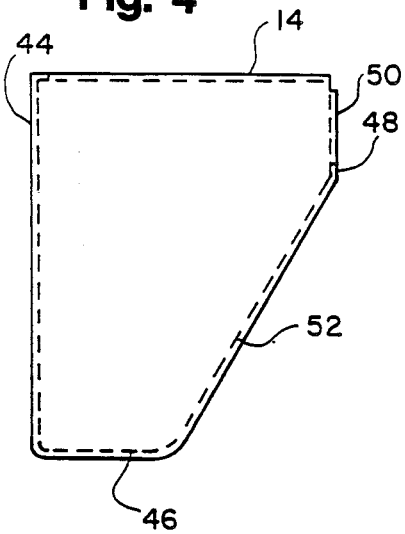
FIG. 4 of the drawings is a side elevational view of the aluminum housing of FIG. 3.

As further seen in FIGS. 3 and 4, aluminum housing 12 preferably comprises a vertical rear wall 44, a bottom surface 46, and a front wall 48 having an aperture 50 extending therethrough. Aperture 50 is preferably formed in a U-shape for reception of manually operable valve 26. Further, front wall 48 preferably has a sloping portion 52. As seen in FIG. 2, the sloped portion 52 of housing 12 facilitates incremental reduction in the size of food bag 22 as food product 24 is dispensed from the food bag 22. In addition, the maximum surface contact is maintained between the bladder 32 and the food bag 22 so as to maintain compression of the food bag 22. Returning to FIGS. 1 and 2, an open top portion 14 is provided for reception of the food bag 22. Cover 18 is provided having an aluminum plate 56, a plastic shield portion 58, and a handle 60.

Figure 5:
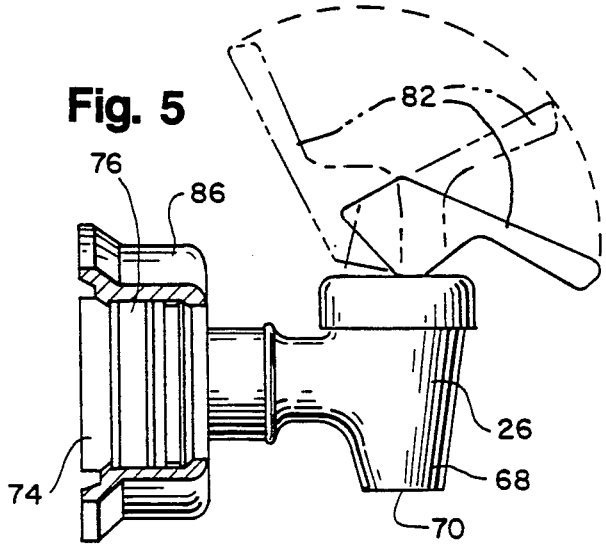
FIG. 5 is a side elevational view of the valve used with the food dispensing apparatus of the present invention.

As best seen in FIGS. 2 and 5 of the drawings, a manually operable valve 26 is provided having a tubular body member 68 with a downwardly disposed aperture 70 and a lumen 72 extending therethrough. A tap portion 74 at a first end 76 of valve member 26 is adapted for fluid communication with the interior 78 of the food bag 22 and for sealing about its periphery 80 to the food bag 22. A pivotal handle member 82 is adapted for selective actuation of a valve mechanism (not shown) contained within the valve 26, which contains a gate which is opened and closed by the movement of the pivotal handle member 82. In a preferred embodiment, the tap portion 74 includes a threaded ring 86 for compression against the tap portion 74 with a portion of the food bag 22 being compressed therebetween, thereby creating a seal between the tap portion 74 and the food bag 22.

As further shown in FIG. 2, a plastic or rubber bladder 32 comprises a bag having a hollow interior, elastic walls and a valve 88 at a first end 90 for selectively allowing the passage of air therein so as to inflate or deflate the bladder 32 as desired. Bladder 32 is preferably 10" in length, has a quarter inch port and a volume of 441 cubic inches. An aperture 62 extends through one of the walls of the aluminum housing 12 and a pressure tube 64 interconnects the bladder 32 with a source of the pressurized air 34. A valve 66 is provided for selective connection and disengagement of the source of pressurized air 34 with the bladder 32.

Figure 6:
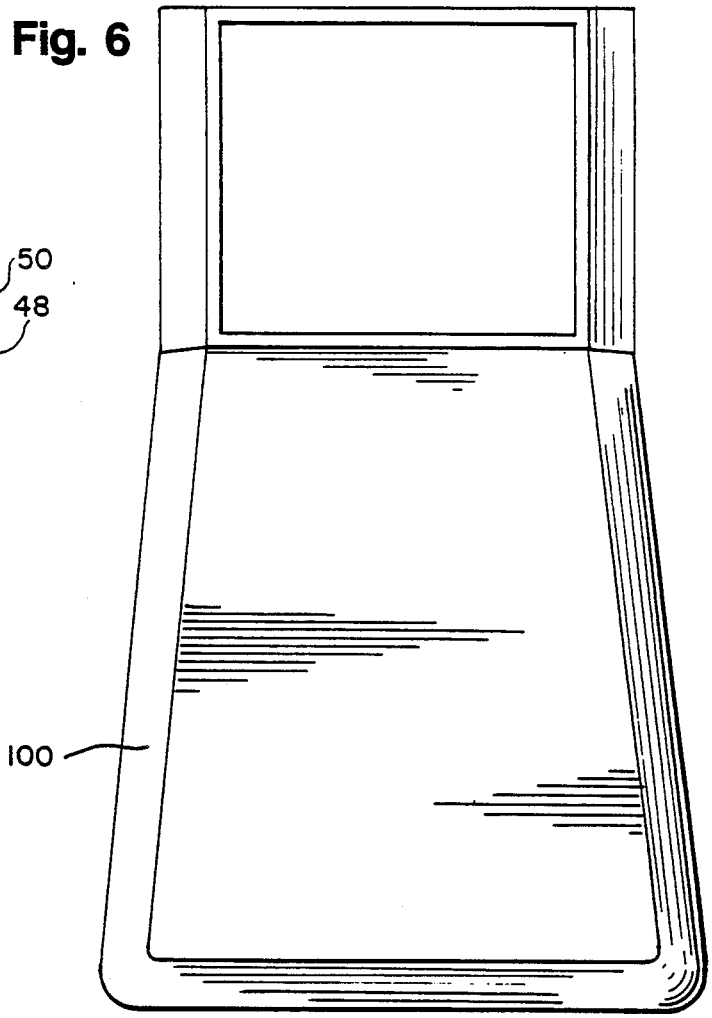
FIG. 6 of the drawings is a top view of the base of the food dispensing apparatus of FIG. 1.
Figure 7:
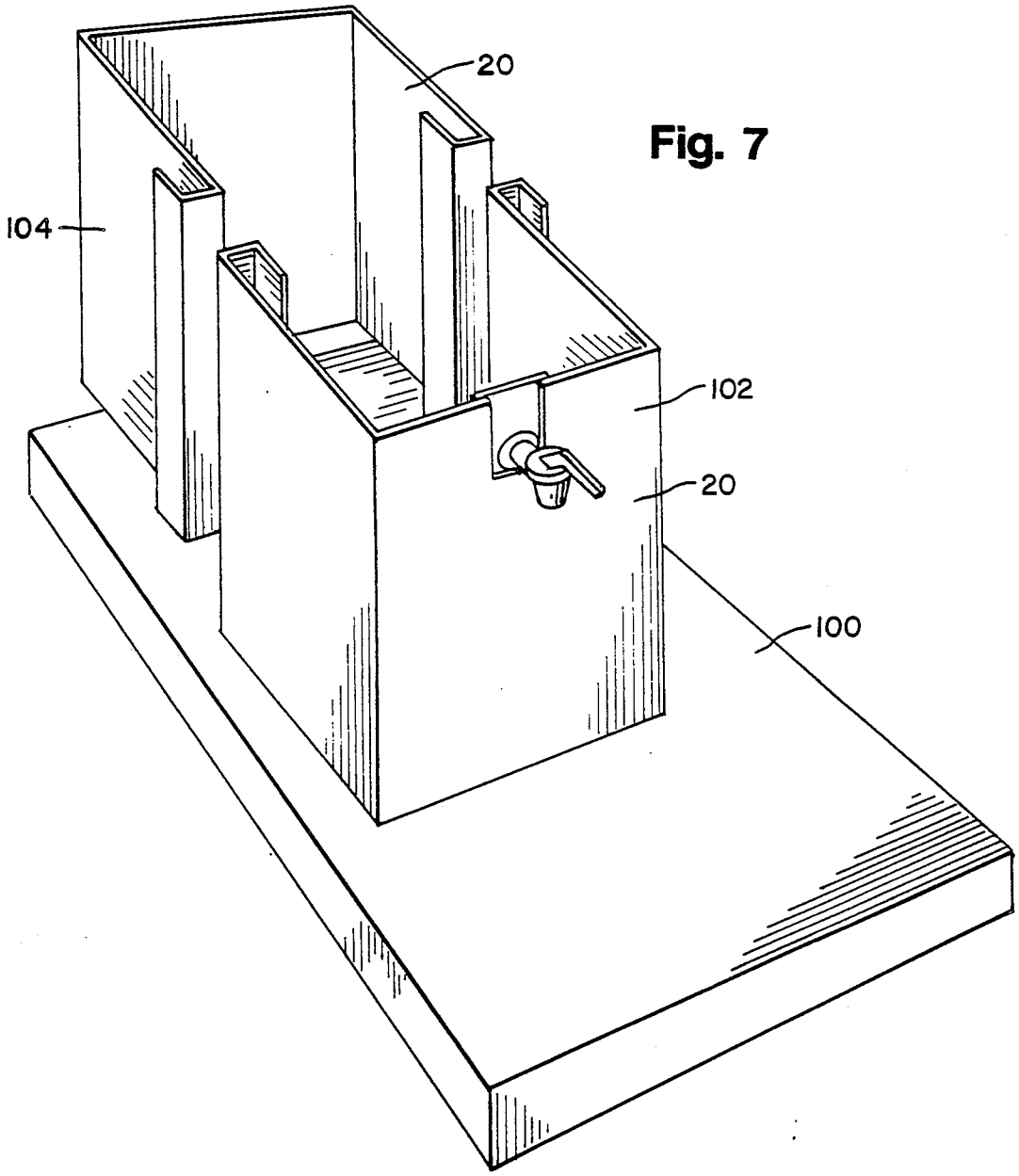
FIG. 7 is an exploded view of the left side and right side of the external enclosure of the food dispensing apparatus of FIG. 1.

Turning to FIGS. 2 and 7 of the drawings, the thermoplastic enclosure 20 preferably comprises quarter inch thick acryli-nitrile butadiene styrene (ABS). In a preferred embodiment, R12 type ABS from Uniroyal is utilized. It is further shown in FIGS. 2 and 7, that enclosure 20 preferably comprises two side portions 102 and 104, respectively, and a top portion which is the plastic shield portion 58 of cover 18. Side portions 102 and 104 are separately formed and subsequently interlocked together and attached to base member 100 as illustrated in FIGS. 2, 6 and 7. In an alternative embodiment, the enclosure 20 may be formed as a single piece.

In a preferred embodiment, the food bag 22 is preferably constructed of 2 mil low-density polyethylene and has a capacity of 144 fluid ounces. Obviously, other materials and sizes may be utilized as desired.

An additional aspect of the invention is the provision of a source of pressurized air 34. In a preferred embodiment, pressurized air is provided by an air compressor 106 having an air line connected to bladder 32. Compressor 106 preferably produces 50 pounds per square inch of pressure, and has a regulator 108 attached thereto for reducing the pressure to three to 5 pounds per square inch. Alternatively, pressure tube 64 may be connected to a wall mounted source of pressurized air, (not shown) or a tank of pressurized air (not shown).

Figure 8:
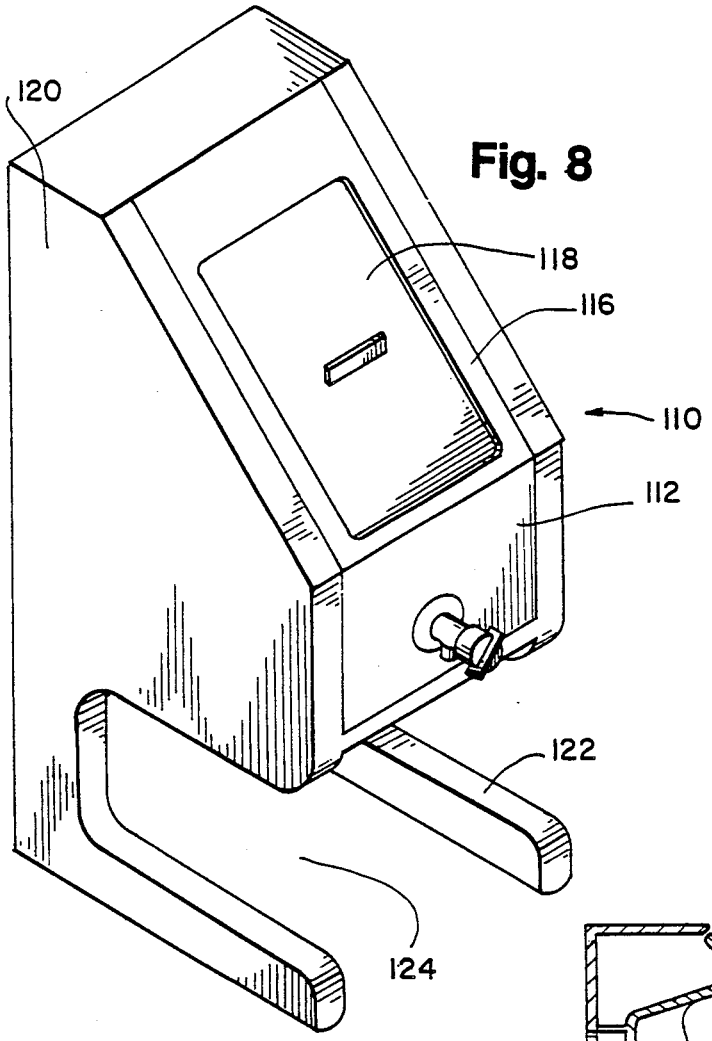
FIG. 8 is a front perspective view of an alternative embodiment of the food dispensing apparatus of FIG. 1 showing in particular, a housing having a removable cover wherein the housing may be pressurized and sealed without the use of an internal bladder.
Figure 10:
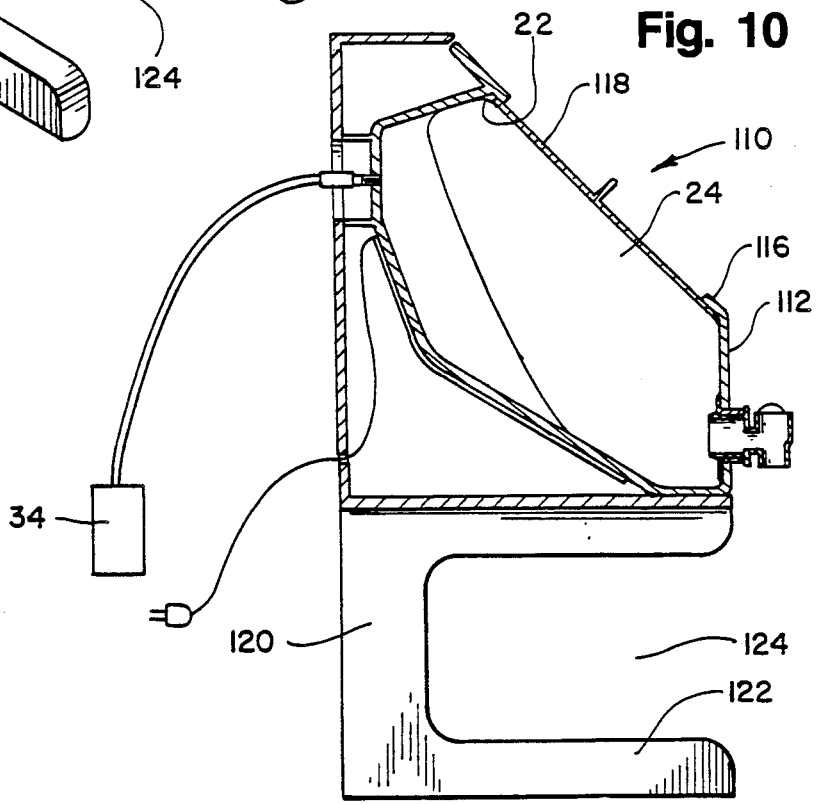
FIG. 10 is a side cut away view taken along line B—B of the food dispensing apparatus of FIG. 8.
Figure 9:
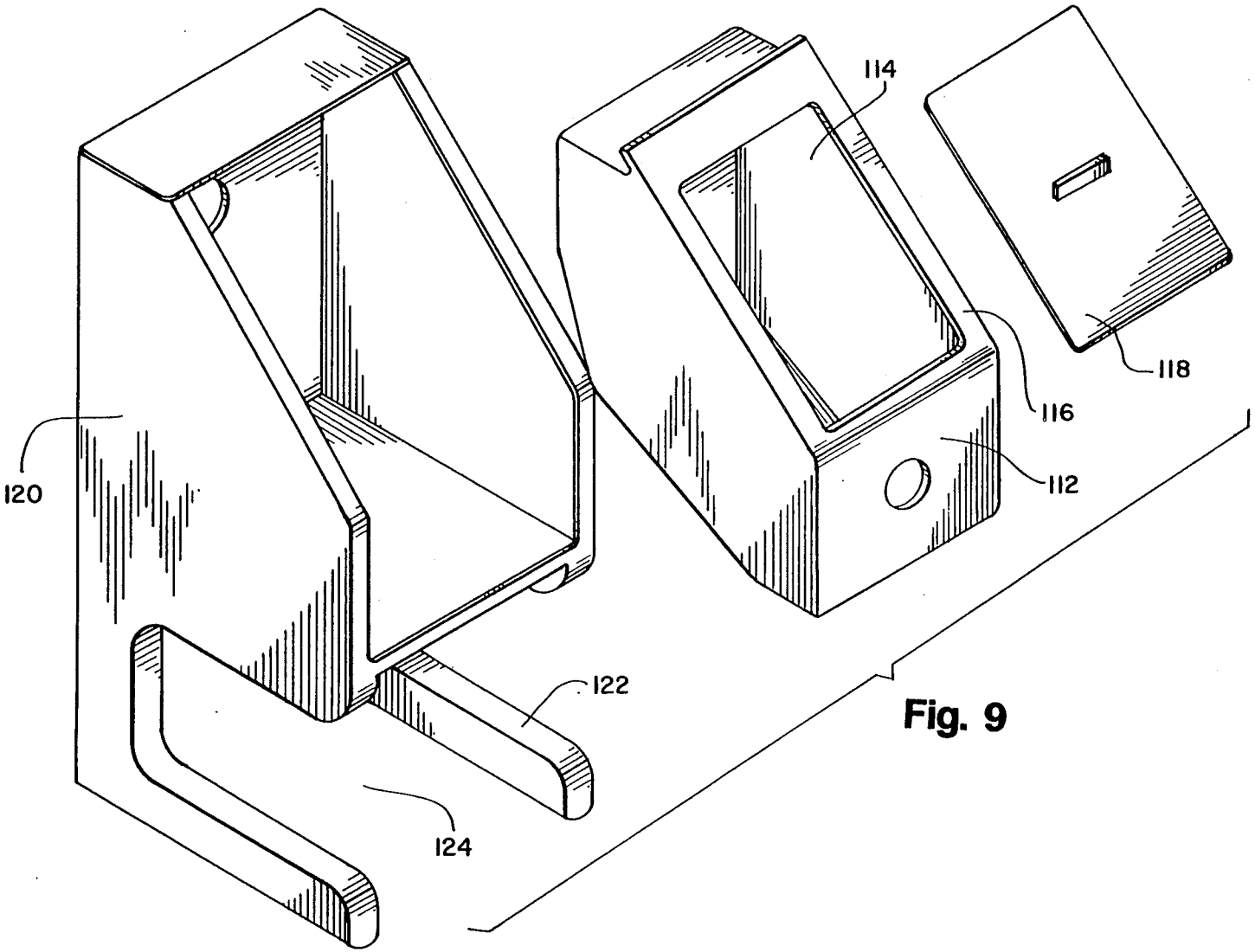
FIG. 9 of the drawings is an exploded view of the food dispensing apparatus of FIG. 8.

Turning now to FIGS. 8, 9 and 10 of the drawings, in an alternative embodiment, a food dispensing apparatus 110 is provided having an aluminum housing 112, having an opening 114 proximate its top surface 116. A cover 118 is provided for sealing the opening 116. Again, an outer enclosure 120 is disposed about the housing 112. A bag 22, identical to that disclosed in FIG. 1 is contained within the housing 112. However, in this embodiment, cover 118 is selectively sealed about its periphery against the opening 114 of housing 112. As shown in FIG. 10, a source of pressurized air 34 is provided as well as a valve 26. However, the source of pressurized air pressurizes the interior of the housing 112 when cover 118 is sealed. Again, as a result, the product 24 within food bag 22 is compressed so as to be dispensed from valve 26. In this embodiment, the valve is located beneath the bulk of the product 24 so that a gravity feed is also effectuated. Valve 26 may be utilized for selectively venting the interior of housing 112 so that cover 118 and bag 22 may be removed as desired. In a preferred embodiment, cover 118 is constructed of lexan ® which is clear so as to enable viewing through the cover 118 to see the quantity of product 24 remaining in bag 22. Base 122 is provided having a cut out portion 124 so as to allow a container (not shown) to be disposed beneath valve 26 for dispensing of the product therein.

Returning to FIG. 2 of the drawings, in a preferred embodiment, bladder 32 has a series of folds 126 formed therein so as to allow expansion of bladder 32 when inflated, which allows uniform compression of food bag 22.

Although the present invention is directed primarily to dispensing of heated food products, it is equally useful for unheated products and heating mechanism 34 may be selectively dispensed when these applications are required.

The foregoing description and drawings merely explain the invention and the invention is not limited thereto except insofar as those who have the disclosure before them are able to make modifications and variations therein without departing from the scope of the invention.

I claim as my invention:

1. A food dispensing apparatus comprising:

an aluminum housing having a front wall and an opening proximate the top surface;

a cover for said opening;

a base portion;

an outer enclosure disposed about said housing;

a food bag containing a food product, said food bag being disposed within said aluminum housing;

a manually operable valve attached to a first end of said food bag, in fluid communication therewith, said valve being selectively operable to dispense food product from said food bag, as desired;

heating means attached to said aluminum housing for heating said housing, thereby, inductively heating said food product in said food bag;

a bladder connectable to a source of pressurized air, said bladder being disposed within said aluminum housing and abutting said food bag so that inflation of said bladder compresses said food bag, thereby permitting selective dispensing of said food product from said food bag.

2. The food dispensing apparatus of claim 1, wherein said heating means comprises an electric heating pad fixedly attached to said housing.

3. The food dispensing apparatus of claim 2, wherein said heating pad requires a current of 110 volts±10, a resistance of 350 watts and is effective to heat said aluminum housing to a temperature of between 120 degrees and 140 degrees Fahrenheit, as desired.

4. The food dispensing apparatus of claim 2, wherein said heating means further comprises a thermostat connected thereto for controlling the temperature of said heating means and thereby the temperature of said aluminum housing.

5. The food dispensing apparatus of claim 2, wherein said heating pad comprises a 5" by 8" by 0.20" thick pad.

6. The food dispensing apparatus of claim 5, wherein said pad is constructed of a material from the group consisting of:

thermoplastic polymers, elastomers, and thermoplastic elastomers.

7. The food dispensing apparatus of claim 1, wherein said aluminum housing comprises 3/16" thick aluminum, of 319 grade.

8. The food dispensing apparatus of claim 1, wherein said aluminum housing comprises:

a vertical rear wall, a bottom surface and said front wall having an aperture extending therethrough, said aperture being adapted for reception of said manually operable valve, said front wall further having at least a portion sloped so as to facilitate compression of said food bag;

said opening proximate the top surface adapted for reception of said food bag and said cover; and a pair of side walls extending substantially vertically from said bottom surface and interconnecting said front and rear walls of said housing.

9. The food dispensing apparatus of claim 1, wherein said manually operable valve comprises:

a tubular body member having a downwardly disposed aperture and a lumen extending therethrough;

a tap portion at a first end of said manually operable valve said tap portion being adapted for fluid communication with the interior of said food bag and about its periphery for sealing to said food bag;

a pivotal handle member adapted for selective actuation;

a valve mechanism contained within said tubular body member for selective opening and closing of said aperture when said valve mechanism is depressed to a first position or return to a second position respectively.

10. The food dispensing apparatus of claim 9, wherein said tap portion is threaded about its periphery and a threaded ring is provided for threaded attachment to and compression against said tap portion with said food bag being disposed therebetween thereby sealing said tap portion to said food bag.

11. The food dispensing apparatus of claim 9, wherein said valve is heat sealed to said food bag so as to hermetically seal the connection between said food bag and said tap portion.

12. The food dispensing apparatus of claim 9, wherein said valve is constructed of a heat resistant thermoplastic material.

13. The food dispensing apparatus of claim 1, wherein said bladder comprises:

a rubber bag having a hollow interior, elastic walls and a valve at a second end for selectively allowing the passage of air therein so as to inflate said rubber bag or deflate said rubber bag as desired.

14. The food dispensing apparatus of claim 13, wherein said bladder comprises:

a bag ten inches in length having a quarter inch port and a volume of 441 cubic inches.

15. The food dispensing apparatus of claim 1, wherein said heating means comprises:

a foam insulation layer disposed across the back thereof for preventing overheating of said food bag.

16. The food dispensing apparatus of claim 1, wherein said heating means comprises switch means for selectively actuating said heating means and visual indicia means for indicating the condition of said heating means.

17. The food dispensing apparatus of claim 1, wherein said enclosure comprises two side portions and a top portion.

18. The food dispensing apparatus of claim 1, wherein said food bag comprises:

a polyethylene bag hermetically sealed about its periphery, said bag being constructed of 2 mil polyethylene and having a volume of approximately 144 fluid ounces.

19. The food dispensing apparatus of claim 1, wherein said source of pressurized air comprises:

an air tube running from said bladder to a valve, said valve being adapted for connection to a wall mounted external source of pressurized air.

20. The food dispensing apparatus of claim 1, wherein said source of pressurized air comprises:

a compressed air tank having an air tube connected to said bladder.

21. The food dispensing apparatus of claim 1, wherein said manually operable valve extending from said food bag is disposed at least 10" from above said base portion so as to allow easy insertion of a container under said valve and filling of said container with said food product.

22. The food dispensing apparatus of claim 1 wherein said front wall of said aluminum housing and outer enclosure are indented and said base portion extends horizontally under said manually operable valve so as to allow easy filling of a container with products from said manually operable valve.

23. The food dispensing apparatus of claim 1, wherein said aluminum housing includes a U-shaped aperture formed in said front wall proximate the top thereof, said U-shaped aperture being adapted for reception of and engagement with said manually operable valve, said manually operable valve further comprising a pair of circular flanges extending therefrom adapted for insertion into said aperture formed in said front wall and engagement therewith.

24. A food dispensing apparatus comprising:

a heated aluminum housing having a top portion;

a plastic outer casing;

a food bag containing a food product residing within said aluminum housing;

a source of compressed air connected to said housing;

means for sealing said housing with said food bag contained therein;

a valve extending from said food bag through said aluminum housing and said plastic outer casing for dispensing said food product;

sealing means for sealing said valve on said casing so as to retain pressure within said housing;

a cover selectively removable from said top portion of said housing so as to allow insertion and removal of food bags; and means for sealing said cover on said housing when said housing is pressurized.

25. The food dispensing apparatus of claim 24, further comprising means for selectively venting said housing as desired.

26. The food dispensing apparatus of claim 24, wherein said cover comprises clear lexan® so as to allow viewing of said product within said outer casing.

27. A food dispensing apparatus comprising:

an aluminum housing having an opening proximate the top surface;

a cover for said opening;

a base portion;

an outer enclosure disposed about said housing;

a food bag containing a food product, said food bag being disposed within said aluminum housing;

a manually operable valve attached to a first end of said food bag, in fluid communication therewith, said valve being selectively operable to dispense food product from said food bag, as desired;

said aluminum housing comprising a vertical rear wall, a bottom surface and front wall having an aperture extending therethrough, said aperture being adapted for reception of said manually operable valve, said front wall further having at least a portion sloped so as to facilitate compression of said food bag;

said opening proximate the top surface adapted for reception of said food bag and said cover;

a pair of side walls extending substantially vertically from said bottom surface and interconnecting said front and rear walls of said housing;

heating means attached to said aluminum housing for heating said housing thereby inductively heating said food product in said food bag;

a bladder connectable to a source of pressurized air, said bladder being disposed within said aluminum housing and abutting said food bag so that inflation of said bladder compresses said food bag, thereby permitting selective dispensing of said food product from said food bag.

28. The food dispensing apparatus of claim 27, wherein said aluminum housing further comprises:

an aperture extending through one of said walls; and a pressure tube extending between and interconnecting said bladder and said source of pressurized air.

29. The food dispensing apparatus of claim 28, wherein said pressure tube further comprises:

a valve adapted for selective connection and disengagement of said source of pressurized air from said bladder.

30. The food dispensing apparatus of claim 27, wherein said outer enclosure is constructed of thermoplastic material and comprises a first side portion and a second side portion interconnected by interlocking channels formed along the leading edges of each respective side portion, said channels being interlocked to form a structurally rigid member for supporting said enclosure, whereby said enclosure may be constructed of a thinner gauge plastic material so as to reduce cost.

31. The food dispensing apparatus of claim 30, wherein said thermoplastic enclosure comprises a quarter inch thick acryli nitrile butadiene styrene.

32. The food dispensing apparatus of claim 27, wherein said cover comprises:

an aluminum plate, having a flange adapted for engagement with the periphery of said housing about its open top portion;

a handle extending from said aluminum plate; and a plastic shield extending above said aluminum plate for preventing contact by the hand of the user with the aluminum plate when heated.

33. The food dispensing apparatus of claim 27, wherein said source of pressurized air comprises:

an air compressor, an air line connecting said air compressor to said bladder, said air compressor having a maximum capacity of 50 pounds per square inch; and a regulator for reducing said air pressure to three to five pounds per square inch.

34. The food dispensing apparatus of claim 27, wherein said bladder comprises a bag having a plurality of folds formed therein, said folds being adapted to expand under pressure so as to compress said food bag within said aluminum housing.

35. The food dispensing apparatus of claim 34, wherein said front wall of said aluminum housing and said folds formed in said bladder combine to compress said food bag across the entire back surface thereof so as to more fully dispense said food product within said food bag.

36. A food dispensing apparatus comprising:

an aluminum housing having an opening proximate the top surface;

a cover for said opening;

an outer enclosure disposed about said housing;

a food bag containing a food product, said bag being disposed within said aluminum housing;

a manually operable valve attached to a first end of said food bag, in fluid communication therewith, said valve being selectively operable to dispense food product from said food bag, as desired;

a separate elastic bladder connectable to a source of pressurized air, said bladder being disposed within said aluminum housing and abutting said food bag so that inflation as of said bladder compresses said food bag, thereby permitting selective dispensing of said food product from said food bag.

37. A food dispensing apparatus comprising:

an aluminum housing having a front surface and an opening proximate the top surface;

a cover for said opening;

a base portion;

an outer enclosure disposed about said housing;

a food bag containing a food product, said food bag being disposed within said aluminum housing;

a manually operable valve attached to a first end of said food bag, in fluid communication therewith, said valve being selectively operable to dispense food product from said food bag, as desired;

heating means attached to said aluminum housing for heating said housing, thereby inductively heating said food product in said food bag, said heating means comprising a foam insulation layer disposed across the back thereof for preventing overheating of said bag;

a bladder connectable to a source of pressurized air, said bladder being disposed within said aluminum housing and abutting said food bag so that inflation of said bladder compresses said food bag, thereby permitting selective dispensing of said food product from said food bag.

38. A food dispensing apparatus comprising:

a heated aluminum housing having a top portion;

a plastic outer casing;

a food bag containing a food product residing within said aluminum housing;

a source of compressed air connected to said housing;

means for sealing said housing with said food bag contained therein;

a valve extending from said food bag through said aluminum housing and said plastic outer casing for dispensing said food product;

sealing means for sealing said valve on said casing so as to retain pressure within said housing;

a cover selectively removable from said top portion of said housing so as to allow insertion and removal of food bags, said cover comprising clear Lexan® so as to allow viewing of said product within said outer casing; and means for sealing said cover on said housing once said housing is pressurized.

* * * * *